US005711370A

United States Patent [19]

Tanaka

[11] Patent Number: 5,711,370

[45] Date of Patent: Jan. 27, 1998

[54] INLET AND OUTLET UNION MECHANISMS OF A HEAT EXCHANGER

[75] Inventor: Hiroshi Tanaka, Isesaki, Japan

[73] Assignee: Sanden Corporation, Gunma, Japan

[21] Appl. No.: 659,514

[22] Filed: Jun. 6, 1996

[30] Foreign Application Priority Data

Jun. 9, 1995 [JP] Japan ..... 7-168303

[51] Int. Cl.[6] ..... F28F 9/04

[52] U.S. Cl. ..... 165/178; 165/175; 165/153; 285/93

[58] Field of Search ..... 165/178, 153, 165/175, 173, DIG. 455; 285/286, 93

[56] References Cited

U.S. PATENT DOCUMENTS

| | | | |
|---|---|---|---|
| 4,957,158 | 9/1990 | Ando . | |
| 5,052,480 | 10/1991 | Nakajima et al. | 165/173 X |
| 5,105,877 | 4/1992 | Ando . | |
| 5,163,716 | 11/1992 | Bolton et al. | 165/173 X |
| 5,186,246 | 2/1993 | Halstead | 165/173 X |
| 5,186,248 | 2/1993 | Halstead | 165/173 |
| 5,209,290 | 5/1993 | Chigira . | |
| 5,228,727 | 7/1993 | Tokutake et al. | 165/178 X |
| 5,240,068 | 8/1993 | Tokutake | 165/173 X |
| 5,346,003 | 9/1994 | Halstead et al. | 165/178 X |
| 5,419,042 | 5/1995 | Kado . | |
| 5,477,919 | 12/1995 | Karube | 165/178 X |

FOREIGN PATENT DOCUMENTS

| | | | |
|---|---|---|---|
| 5180592 | 7/1993 | Japan | 165/178 |
| 5203387 | 8/1993 | Japan | 165/178 |
| 6229696 | 8/1994 | Japan | 165/178 |

OTHER PUBLICATIONS

European Search Report, completed Sep. 6, 1996, The Hague.

*Primary Examiner*—John Rivell
*Assistant Examiner*—Christopher Atkinson
*Attorney, Agent, or Firm*—Baker & Botts, L.L.P.

[57] ABSTRACT

A heat exchanger for conducting a fluid comprises a plurality of heat transfer tubes, a plurality of fins sandwiched by the heat transfer tubes, and first and second header pipes fixedly and hermetically mounted to the heat transfer tubes. A pair of union joint devices are disposed in the first and second header pipes respectively. Each of the union joint devices comprises a brazed area wherein one end of a fluid passage disposed therein is brazed to a hole formed on the header pipe. A space is created around the brazed area for observing a condition of brazing and insuring a flux therein. Thereby, the heat exchanger has completely hermetic connections between the union joint and header pipes and is easily examined by an operator to detect any improper brazing between the union joint and the header pipes.

24 Claims, 7 Drawing Sheets

INLET AND OUTLET UNION MECHANISMS OF A HEAT EXCHANGER

FIELD OF THE INVENTION

The present invention relates generally to a heat exchanger and more particularly, to a union joint mechanism for inlet and outlet ports suitable for use in automotive air conditioning systems.

BACKGROUND OF THE INVENTION

A heat exchanger may comprise one or more header pipes, an inlet port for introducing a fluid into the header pipes, and an outlet port for discharging the fluid from the header pipes. The inlet port and outlet port are fixedly and hermetically connected to the header pipes to circulate the fluid in the heat exchanger. In this arrangement, the inlet and outlet ports are generally connected to the header pipes by brazing.

With reference to FIG. 1, Japanese Utility Model publication No. H3-128275 discloses a pair of header pipes 13 each having a union joint mechanism thereon for joining an inlet pipe 15 and an outlet pipe 16, respectively. A union joint mechanism includes union element 14 which is directly connected to header pipe 13 by brazing. Thereby, inlet pipe 15 or outlet pipe 16 may be fixedly and hermetically joined with union element 14 for the purpose of freely selecting the position of inlet pipe 15 or outlet pipe 16 and increasing the strength of a union joint mechanism.

Further, in such union joint mechanisms, union element 14 includes a fluid passage 14*a* integrally formed therein. One end of fluid passage 14*a* protrudes into the interior of header pipe 13. That end of fluid passage 14*a* is connected to hole 13*a* of header pipe 13 by brazing. Union element 14 may be made of a high hardness aluminum alloy, such as A7000 series aluminum alloys, which provides a strong body although such material is generally difficult to braze properly.

One attempt to resolve these disadvantages may be shown with reference to Japanese Patent H6-31333. Referring to FIG. 2, union element 17 comprises an opening 17*a* formed therein. A sleeve member 18 may be inserted into opening 17*a* so that sleeve member 18 protrudes into the interior of header pipe 13. Fluid may flow through the inner surface of sleeve member 18. Sleeve member 18 may be made of a material which is easily brazed in character. Thereby, sleeve member 18, which functions as a fluid path, may be securely connected to header pipe 13 by brazing.

In this arrangement, however, a flux material must be coated on the areas at which sleeve member 18 is connected to hole 13*a* of header pipe 13 and union element 17 is connected to the peripheral surface of header pipe 13 before brazing. This coating work is difficult because the areas to be coated are hidden by union element 17 when union element 17 is set on header pipe 13. Without the coating, however, the areas are difficult to braze and as a result, the heat exchanger may leak heat exchanger fluid at the brazing area and may have weak connections between header pipe 13 and union element 17. On the other hand, if excess flux is coated on the connection areas to attempt to prevent leakage of the fluid and weakness of the connection, the flux flows into the interior of fluid passage 17*a* or sleeve member 18. Consequently, the heat exchanger does not seal properly when the heat exchanger is heated up in a furnace for brazing.

Furthermore, the connecting area may not receive a sufficient amount of the brazing material for proper brazing because the brazing material may be absorbed in the gap created between sleeve member 18 and union element 17 or between union element 17 and the outer peripheral of header pipe 13. The leakage of the brazing material in the connecting area may result in leakage of the fluid and a deterioration of pressure strength and may not insure the strength of union element 17.

Moreover, it is difficult to determine whether the flux or the brazing material has been properly coated or brazed to the connecting area because the area created between fluid passage 17*a* or sleeve member 18 and hole 13*a* of header pipe 13 is hidden between union element 14 and 17 and header pipe 13.

SUMMARY OF THE INVENTION

Accordingly, it is an object of the present invention to provide a heat exchanger which is easy to manufacture and has completely hermetic connections between a union joint and a header pipe.

It is another object of the present invention to provide a heat exchanger that may be readily examined to determine any possible failure of brazing between a union joint and a header pipe.

In order to achieve these and other objects, the present invention comprises a heat exchanger for conducting a fluid. The heat exchanger comprises a plurality of heat transfer tubes having opposite first and second ends respectively. A plurality of fins are sandwiched by the heat transfer tubes. First and second header pipes are fixedly and hermetically connected to one of the opposite ends of each of the heat transfer tubes. A pair of union joint devices are disposed in the first and second header pipes respectively for linking the heat exchanger to an external element of a fluid circuit. Each of the union joint devices includes a union member therein, a fluid passage disposed in the union member, and a brazed area wherein one end of the fluid passage is brazed to a hole formed on the header pipe. A space is created around the brazed area for enabling a person to examine the condition of brazing and insuring a flux therein.

Other objects, features and advantages will be apparent to persons of ordinary skill in the art in view of the following detailed description of the invention and the accompanying drawings.

DETAILED DESCRIPTION OF THE PREFERRED EMBODIMENTS

Figure 1:
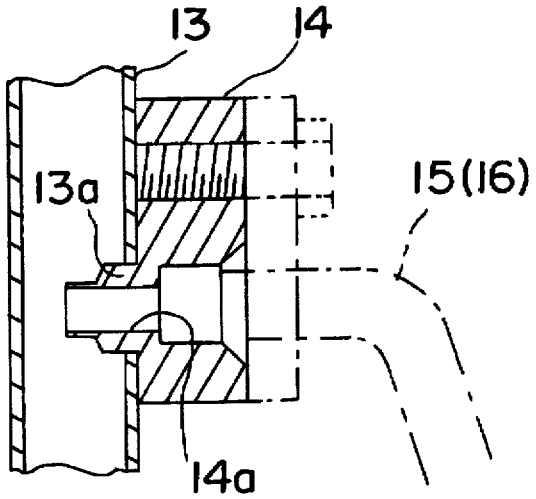
FIG. 1 PRIOR ART
FIG. 1 is an enlarged partial cross sectional view of a union joint mechanism of a heat exchanger according to an embodiment of the prior art.
Figure 2:
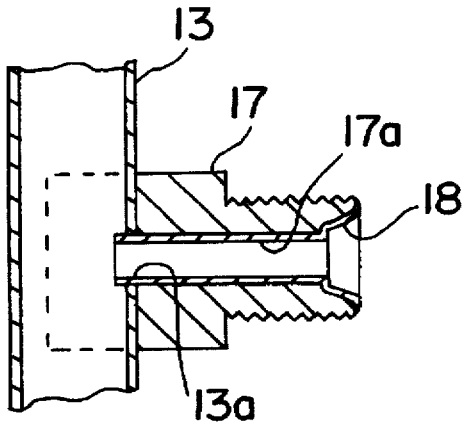
FIG. 2 PRIOR ART
FIG. 2 is an enlarged partial cross sectional view of a union joint mechanism of a heat exchanger according to another embodiment of the prior art.
Figure 3:
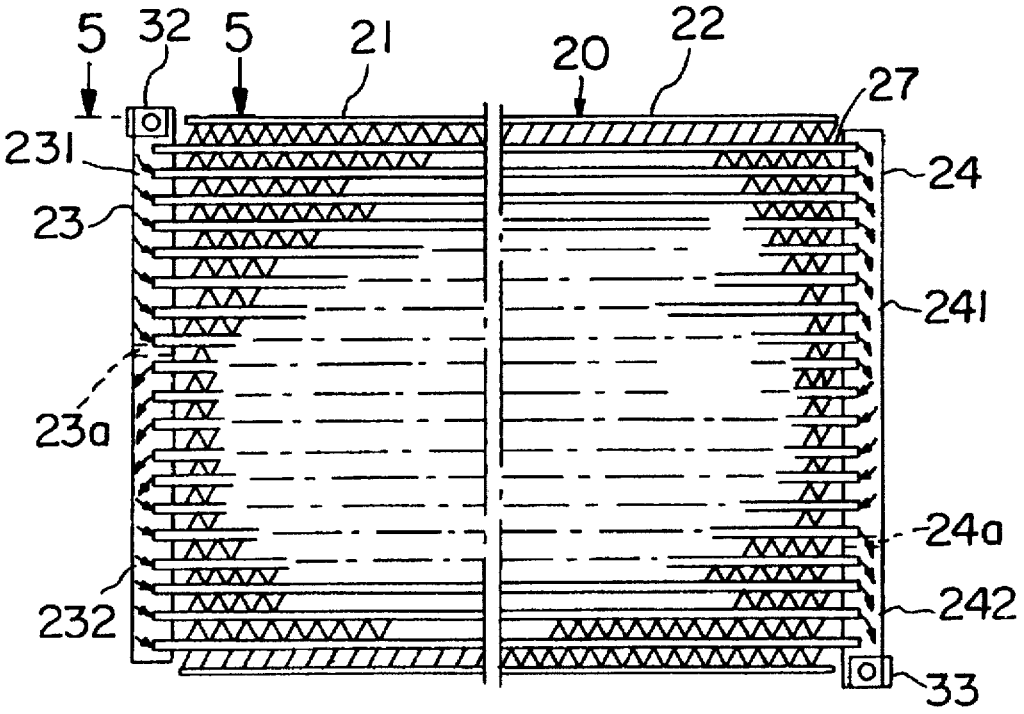
FIG. 3 is an elevational view of a heat exchanger according to an embodiment of the present invention.
Figure 4:
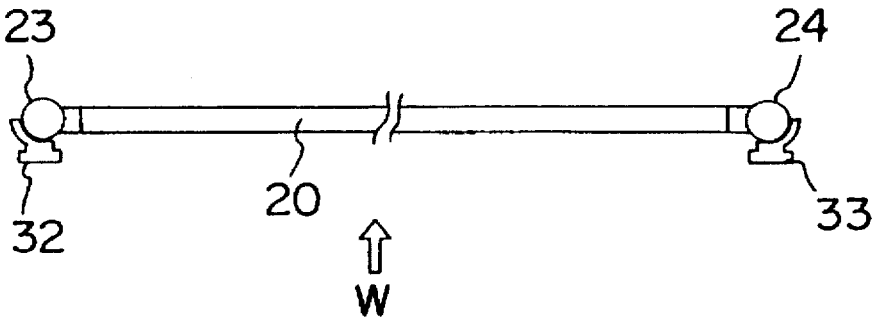
FIG. 4 is a top view of the heat exchanger shown in FIG. 3.

FIGS. 3 and 4 depict a heat exchanger for an automotive air conditioning system according to an embodiment of the present invention. In this embodiment, a heat exchanger 20 includes a plurality of adjacent, essentially flat tubes 21 having an oval cross section and open ends which allow refrigerant fluid to flow therethrough. A plurality of corrugated fin units 22 may be disposed between adjacent tubes 21. Circular header pipes 23 and 24 may be disposed substantially perpendicularly to flat tubes 21 and may have, for example, a clad construction. Flat tubes 21 are fixedly connected to header pipes 23 and 24 and disposed in slots 27 such that the open end of flat tubes 21 communicate with the hollow interior of header pipes 23 and 24.

Header pipe 23 may have a closed top end and a bottom end. Inlet union joint mechanism 32 may be fixedly and hermetically connected to header pipe 23. Inlet union joint mechanism 32 may also be linked to the outlet of a compressor (not shown). Partition wall 23*a* may be fixedly disposed within header pipe 23 at a location about midway along its length and may divide header pipe 23 into an upper cavity 231 and a lower cavity 232, which is isolated from upper cavity 231. Second header pipe 24 may also have a closed top end and a bottom end. Outlet union joint mechanism 33 may be fixedly and hermetically connected to header pipe 24. Outlet union joint mechanism 33 may be linked to the inlet of a receiver (not shown). Partition wall 24*a* may be fixedly disposed within second header pipe 24 at a location approximately one third of the way along the length of second header pipe 24 and may divide second header pipe 24 into an upper cavity 241 and a lower cavity 242, which is isolated from upper cavity 241. The location of partition wall 24*a* may be lower than the location of partition wall 23*a*.

In operation, compressed refrigeration gas from a compressor flows into upper cavity 231 of first header pipe 23 through inlet union joint mechanism 32 and is distributed such that a portion of the gas flows through each of flat tubes 21 which is disposed above partition wall 23*a* and into an upper portion of upper cavity 241. Thereafter, the refrigerant in the upper portion of upper cavity 241 flows downward into the lower portion of upper cavity 241 and is distributed such that a portion flows through each of the plurality of flat tubes 21 disposed below partition wall 23*a* and partition wall 24*a*, and into an upper portion of lower cavity 232 of first header pipe 23. The refrigerant in an upper portion of lower cavity 232 flows downwardly into a lower portion of lower cavity 232 and is again distributed such that a portion flows through each of the plurality of flat tubes 21 disposed below partition wall 24*a* and into lower cavity 242 of second header pipe 24. As the refrigerant gas sequentially flows through flat tubes 21, heat from the refrigerant gas is exchanged with the atmospheric air flowing through corrugated fin unit 22 in the direction of arrow W as shown in FIG. 4. Since the refrigerant gas radiates heat to the outside air, it condenses to a liquid refrigerant in lower cavity 242 and flows from lower cavity 242 out through outlet union joint mechanism 33 and into the receiver and the further elements of the circuit as discussed above.

Figure 5:
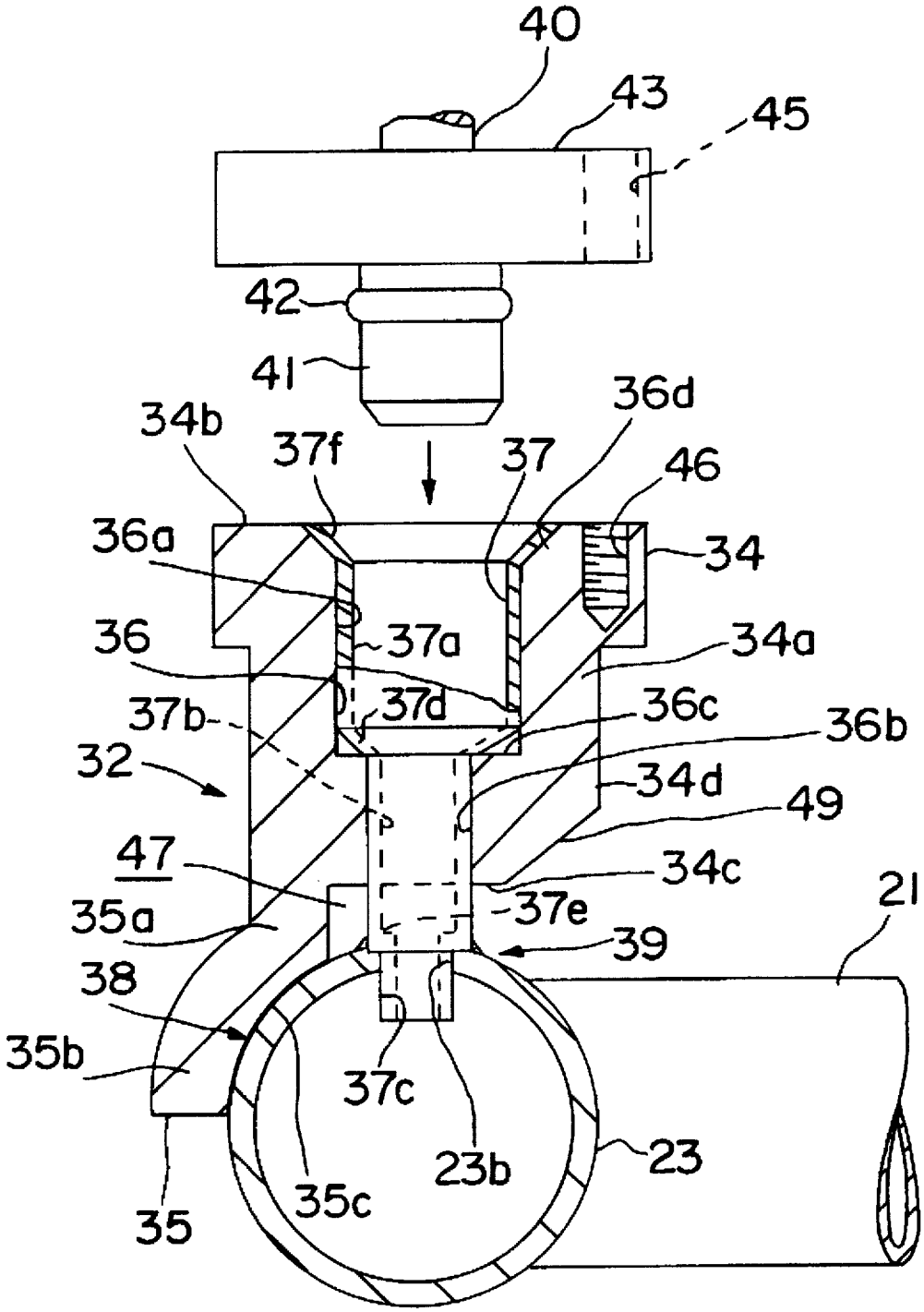
FIG. 5 is an enlarged fragmentary sectional view taken along line 5—5 of FIG. 3.

The details of the union joint mechanism are described below. Referring to FIG. 5, union joint mechanism 32 (33) includes a union element 34 and a sleeve member 37 inserted into an opening 36 integrally formed in union element 34. Union element 34 may comprise a rectangular-shaped body 34*a*, an opening 36 penetrating from a first end surface 34*b* to a second end surface 34*c* of union element 34, and an arm 35 extending from second end surface 34*c*. Arm 35 may comprise a wall portion 35*a*, an arc portion 35*b* extending from wall portion 35*a*, and an inner surface 35*c* of arm 35 formed on arc portion 35*b*. Inner surface 35*c* may be designed to closely contact the peripheral surface of header pipe 23. Opening 36 may comprise a first cylindrical hole 36*a*, a second cylindrical hole 36*b*, a shoulder portion 36*c* joining first cylindrical hole 36*a* to second cylindrical hole 36*b*, and a beveling surface 36*d* joining first end surface 34*b* to first cylindrical hole 36*a*. The inner diameter of first cylindrical hole 36*a* may be larger than that of second cylindrical hole 36*b*.

Sleeve member 37 may comprise a first cylindrical portion 37*a*, a second cylindrical portion 37*b*, a third cylindrical portion 37*c*, a first shoulder portion 37*d* joining first cylindrical portion 37*a* to second cylindrical portion 37*b*, a second shoulder portion 37*e* joining second cylindrical portion 37*b* to third cylindrical portion 37*c*, and a flange portion 37*f* extending from one end of first cylindrical portion 37*a*. The outer diameter of first cylindrical portion 37*a* may be larger than that of second cylindrical portion 37*b*. The outer diameter of second cylindrical portion 37*b* may be larger than that of third cylindrical portion 37*c*. Further, sleeve member 37 may be forcibly inserted into opening 36 of union element 34 such that third cylindrical portion 37*c* and a partial portion of second cylindrical portion 37*b* substantially protrude from second end surface 34*c* of union element 34.

Union element 34 may be made of a metal, for example, such as an aluminum alloy series 7000, which is difficult to braze but is very hard. Sleeve member 37 may be made of a metal, for example, such as an A3000 series aluminum alloy which is easily brazed.

Figure 6:
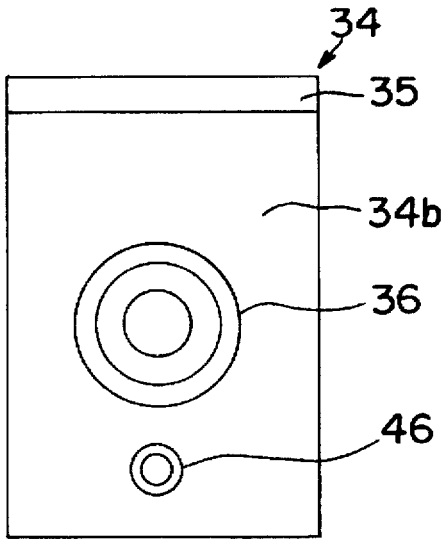
FIG. 6 is an overhead view of a union joint member according to an embodiment of the present invention.
Figure 7:
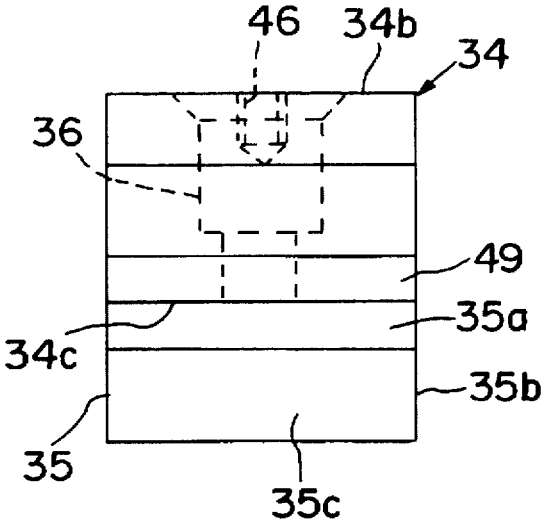
FIG. 7 is a side view of the union joint member shown in FIG. 6.

Referring to FIGS. 6 and 7, union element 34 may comprise a threaded hole 46 straightly penetrating from first end surface 34*b* toward the inside of body 34*a*. Union element 34 may further comprise a cutaway portion 49 formed on a first side surface 34*d*. Cutaway portion 49 may completely join first side surface 34*d* to a second end surface 34*c*.

Figure 8:
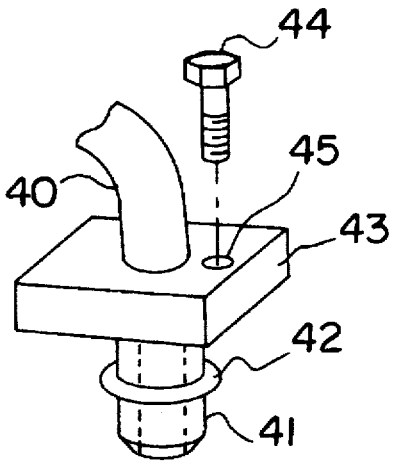
FIG. 8 is schematic view of an external pipe joint member connected to a union joint mechanism according to another embodiment of the present invention.
Figure 9:
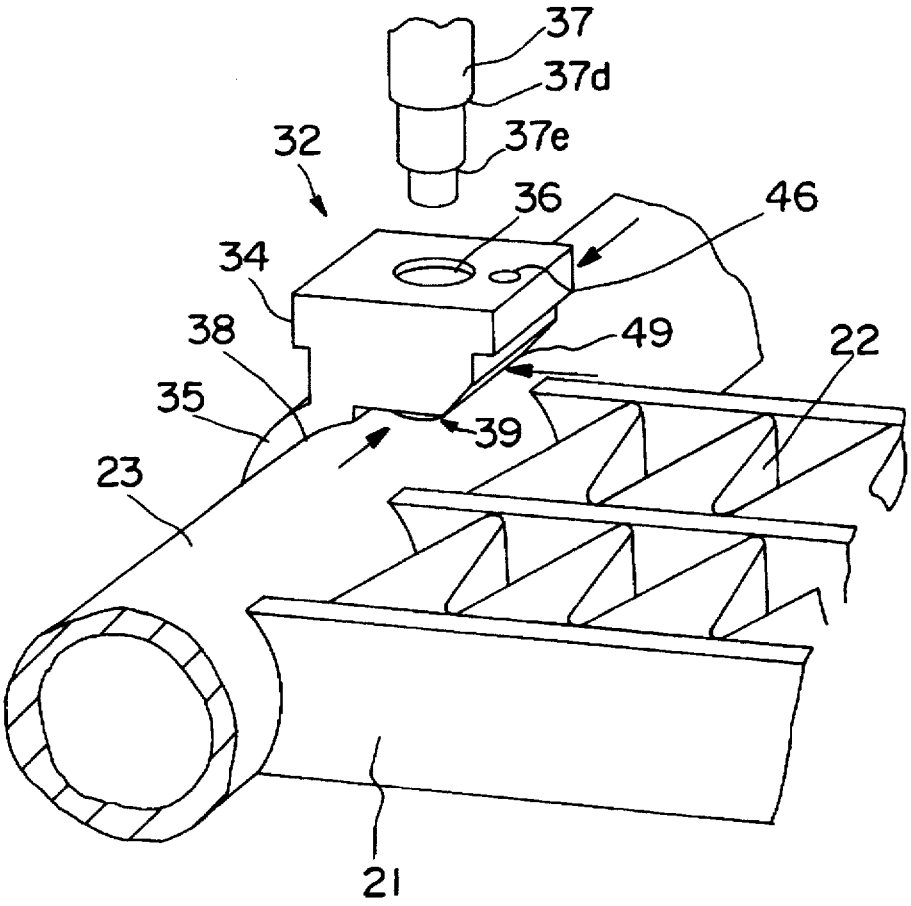
FIG. 9 is a schematic view of a union joint mechanism according to another embodiment of the present invention.

Referring to FIGS. 8 and 9, union element 34 may be securely connected to header pipe 23 at first joint area 38 such that inner surface 37*c* of arm 35 may be brazed to the peripheral surface of header pipe 23. Sleeve member 37 may also be fixedly and hermetically connected to header pipe 23 at second joint area 39 such that second shoulder portion 37*e* may be brazed to the circumference of hole 23*b* of header pipe 23.

Further, the external joint mechanism may comprise a joint block 43, a first pipe member 40 connected to one end surface therein, and a second pipe member 41, which is provided with an "O"-ring 42 thereon, connected to the other end surface therein. Joint block 43 includes hole 45 through which bolt 44 may be passed. After second pipe member 41 is inserted into opening 36 of union element 34, the external joint mechanism may be secured to union joint mechanism 32 such that bolt 44 penetrates hole 45 and is bound in threaded hole 46.

In this arrangement, wall portion 35*a* and second end surface 34*c* collectively form space 47 around the outer peripheral surface of second cylindrical portion 37*b* of sleeve member 37. Therefore, space 47 functions to maintain flux therein without permitting the flux to deviate into other gaps. Further, second joint area 39 may be securely brazed since space 47 also functions to insure a desirable amount of brazing material therein for brazing. Second joint area 39 thus provides superior sealing and strength in construction.

Furthermore, in the process of coating flux, an operator may be able to confirm whether the flux has properly coated second joint area 39 by observing the second joint area 39 through space 47. If it is not sufficiently coated, the flux may be supplemented at second joint area 39. In the process of brazing, the operator may confirm whether second joint area 39 is properly brazed by observing second joint area 39 from three direction as indicated by the arrows shown in FIG. 9. Therefore, if union element 34 includes either inclined portion 49 or space 47, the operator may confirm the coating condition of the flux and the resulting brazing condition as well. As a result, the improvement may decrease the leakage of the fluid from header pipe 23 (24) and may facilitate control of the production process in inspecting leakage of the fluid.

Figure 10:
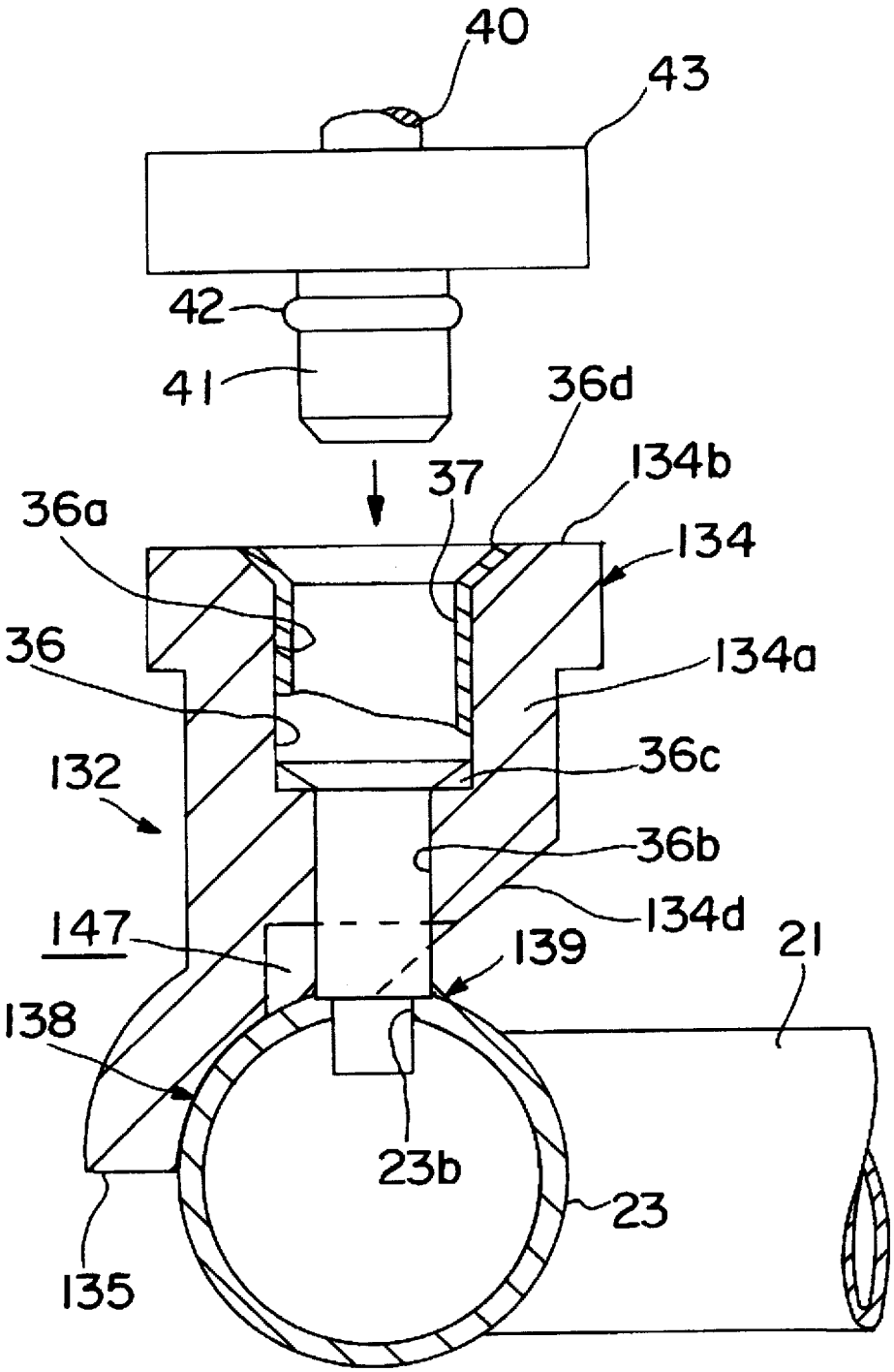
FIG. 10 is an enlarged fragmentary sectional view taken along line 5—5 of FIG. 3 according to another embodiment of the present invention.
Figure 11:
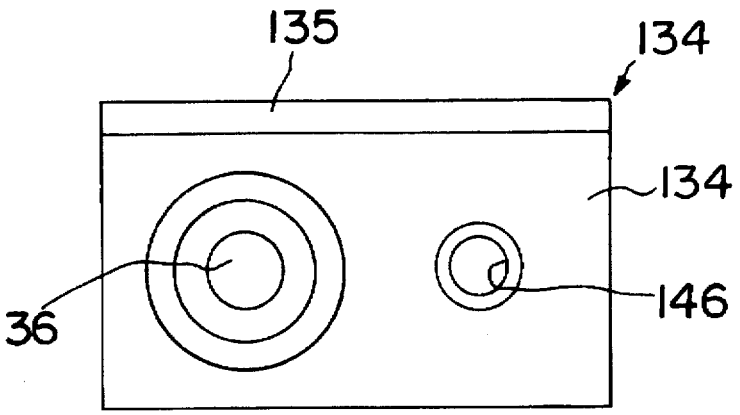
FIG. 11 is an overhead view of union joint member according to another embodiment of the present invention.
Figure 12:
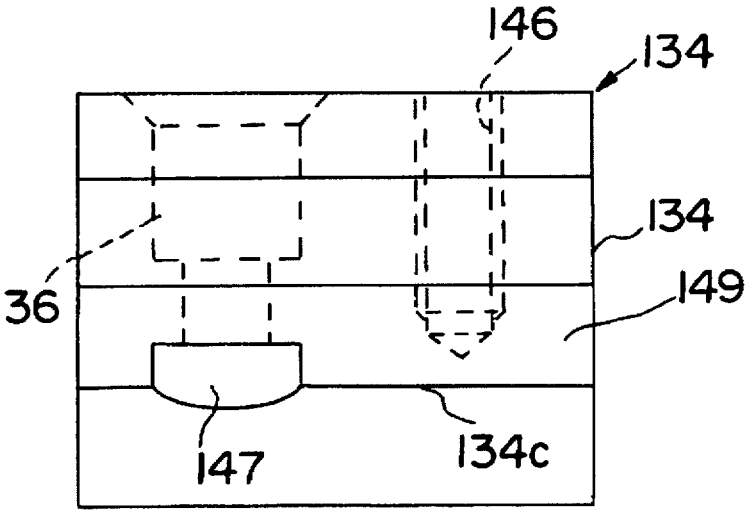
FIG. 12 is a side view of the union joint member shown in FIG. 11.

Referring to FIG. 10, another embodiment of the present invention is depicted. Elements similar to those of the other embodiments are designated with the same references numerals.

A union joint mechanism 132 (133) may comprise a union element 134 and a sleeve member 37 inserted into an opening 36 formed in union element 134. Union element 134 may comprise a rectangular shape body 134*a*, an opening 36 penetrating from a first end surface 134*b* to a second end surface 134*c* of union element 134, and an arm 135 extending from second end surface 134*c*. Union element 134 may comprise a thread hole 146 penetrating straight from first end surface 134*b* toward the inside of body 134*a*. Union element 134 may also comprise a notch portion 147 formed in body 134*a* so as to surround second cylindrical hole 36*b* and extend along the peripheral surface of sleeve member 37. Union element 134 may further comprise a cutaway portion 149 formed on one side surface 134*d*. Cutaway portion 149 inclines toward second end surface 134*c* and completely joins side surface 134*d* to second end surface 134*c*. Union element 134 may be securely connected to header pipe 23 at first joint area 138 such that arm 135 is brazed to the peripheral surface of header pipe 23. Sleeve member 37 may also be fixedly and hermetically connected to header pipe 23 at second joint area 139 such that second shoulder portion 37*e* is brazed to the circumference of hole 23*b* of header pipe 23. This structure also provides the advantages of the embodiments of FIGS. 3–9 as discussed above.

This invention has been described in connection with several embodiments, but these embodiments are merely presented for example only, and the invention should not be construed as limited thereto. It should be apparent to those skilled in the art that other variations or modifications can be made within the scope defined by the appended claims.

What is claimed is:

1. A heat exchanger for conducting a fluid comprising:

a plurality of heat transfer tubes each having opposite first and second ends;

first and second header pipes fixedly and hermetically mounted to the first and second ends, respectively; and a pair of union joint means connected to said first and second header pipes respectively for linking said heat exchanger to an external element of a fluid circuit, each of said union joint means comprising:

a union element;

a fluid passage member disposed in said union element;

a brazed area wherein one end of said fluid passage member is brazed to a hole formed in said first and second header pipes; and wherein said union joint means has a space formed around said brazed area for observing the brazed area, said space extending substantially completely around said area where said fluid passage member is brazed to the hole formed in said header pipe, said space facilitating the flow of flux to said brazed area to effect a more secure connection.

2. The heat exchanger of claim 1, wherein said space is defined by a peripheral surface of said union element, a peripheral surface of said fluid passage member and a peripheral surface of said header pipe.

3. The heat exchanger of claim 1, wherein said space is a notch portion formed in said union element which extends along a peripheral surface of said fluid passage member.

4. The heat exchanger of claim 1, wherein said union element comprises a first end surface, a second end surface, and an opening penetrating from the first end surface to the second end surface, and wherein said fluid passage member is inserted into said opening.

5. The heat exchanger of claim 4, wherein said union element comprises a series 7000 aluminum alloy and said fluid passage member comprises a series 3000 aluminum alloy.

6. The heat exchanger of claim 1, wherein said union element further comprises an arm portion extending from an end surface thereof for brazing to a peripheral surface of said header pipe.

7. The heat exchanger of claim 1, wherein said union element further comprises a cutaway portion formed thereon to expose at least a portion of said brazed area.

8. The heat exchanger of claim 7, wherein said cutaway portion inclininglyy stretches to join a side surface to another surface adjacent to said side surface.

9. The heat exchanger of claim 1, wherein said external element is secured to said union joint means by securing means.

10. The heat exchanger of claim 7, wherein said space is defined by a peripheral surface of said union element, a peripheral surface of said fluid passage member and a peripheral surface of said header pipe.

11. The heat exchanger of claim 7, wherein said space is a notch portion formed in said union element.

12. The heat exchanger of claim 7, wherein said union element comprises a first end surface, a second end surface, and an opening penetrating from the first end surface to the second end surface, and wherein said fluid passage member is inserted into said opening.

13. The heat exchanger of claim 7, wherein said union element includes an arm portion extending from an end surface thereof for brazing to said header pipe.

14. The heat exchanger of claim 12, wherein said union element comprises a series 7000 aluminum alloy and said fluid member comprises a series 3000 aluminum alloy.

15. The heat exchanger of claim 1, further comprising a plurality of fins sandwiched by said heat exchanger tubes.

16. A heat exchanger for conducting a fluid comprising:

a plurality of heat transfer tubes each having opposite first and second ends;

first and second header pipes fixedly and hermetically mounted to the first and second ends, respectively; and a pair of union joint means connected to said first and second header pipes respectively for linking said heat exchanger to an external element of a fluid circuit, each of said union joint means comprising:

a union element;

a fluid passage member disposed in said union element;

a brazed area wherein one end of said fluid passage member is brazed to a hole formed in said first and second header pipes; and a cutaway portion formed in said union element for exposing said brazing area, said cutaway portion extending substantially completely around said brazed area where said fluid passage member is brazed to the hole formed on said header pipe, said cutaway area facilitating the flow of flux to said brazed area to effect a more secure brazed connection and to allow a visual inspection of the entire brazed area.

17. The heat exchanger of claim 16, wherein said cutaway portion incliningly stretches to completely join a side surface to another surface adjacent to the side surface.

18. The heat exchanger of claim 16, further comprising a space defined by said union element, said fluid passage member and said header pipe.

19. The heat exchanger of claim 18, wherein said space is a notch portion formed in said union element.

20. The heat exchanger of claim 16, wherein said union element further comprises a first end surface, a second end surface, and an opening penetrating from the first end surface to the second end surface, and wherein the fluid passage member is inserted into said opening.

21. The heat exchanger of claim 16, wherein said union element includes an arm portion extending from an end surface thereof for brazing to said header pipe.

22. The heat exchanger of claim 16, wherein said union element comprises a series 7000 aluminum alloy and said fluid passage member comprises a series 3000 aluminum alloy.

23. The heat exchanger of claim 16, wherein said external element is secured to said union joint means by securing means.

24. The heat exchanger of claim 16, further comprising a plurality of fins sandwiched by said heat transfer tubes.

* * * * *